United States Patent [19]

Solloway

[11] Patent Number: 4,538,727

[45] Date of Patent: Sep. 3, 1985

[54] NON-COLLAPSIBLE CARRYING KIT

[76] Inventor: James H. Solloway, 11 Dwight Ave., Salem, N.H. 03079

[21] Appl. No.: 610,335

[22] Filed: May 16, 1984

[51] Int. Cl.[3] ..... B65D 85/00; B65D 1/36; A47F 5/08; A47H 1/16

[52] U.S. Cl. ..... 206/223; 220/18; 220/20; 220/DIG. 6; 220/94 A; 248/212; 248/213.2; 206/566; 206/203; 206/806

[58] Field of Search ..... 206/223, 581, 216, 566, 206/203, 561, 806; 220/18, 20, DIG. 6, 94 A; 40/152.1; 248/212, 213, 213.2

[56] References Cited

U.S. PATENT DOCUMENTS

| | | | |
|---|---|---|---|
| 1,835,098 | 12/1931 | Shedd | 40/152.1 |
| 2,876,908 | 3/1959 | Mangum | 248/212 |
| 3,190,490 | 6/1965 | Membrino | 206/806 |
| 3,433,383 | 3/1969 | Phibbs | 220/20 |
| 3,887,103 | 6/1975 | Spooner | 220/20 |
| 3,923,162 | 12/1975 | Hussey | 248/212 |
| 4,442,940 | 4/1984 | McIntosh | 220/18 |

*Primary Examiner*—William T. Dixson, Jr.
*Attorney, Agent, or Firm*—Pearson & Pearson

[57] ABSTRACT

A non-collapsible, one-piece carrying kit with a central, elongated handle is divided into a plurality of cells of different area in plan for transporting personal articles of different size, shape, and configuration. Most of the cells are open at the top, but at least one cell may have an apertured, removable cover. All of the kit walls and partitions are integral and of rigid material, but a hook is pivotally mounted on one wall to suspend it from a shower pipe, or curtain rod when the articles are toilet articles for use in the shower. A double hook may be mounted on one of a plurality of threaded studs.

5 Claims, 5 Drawing Figures

NON-COLLAPSIBLE CARRYING KIT

BACKGROUND OF THE INVENTION

It has heretofore been proposed to provide various containers for storing toiletries in a shower such as hanging soap dishes. As one would expect, there are numerous prior art patents which teach varying methods of suspension from shower heads and curtain rods, as well as varying soap dish designs. It has been found desirable to provide a convenient, compact container or kit for carrying and supporting toiletries in the shower. Such kits known in the art today have been found to have several short comings.

The problems with these prior devices include their similarity to the standard dimensioned 6 pack, used for beer. Such devices have equal area cells which are incompatible with the wide variety of differing shaped toiletries constantly appearing on the market today. Consequently, many common toiletries or cosmetics do not fit into the kit rendering such a device useless. Similarly, these prior devices are difficult and inconvenient to hang or suspend in many shower stalls which today are all designed differently in hotels, schools, etc. If the device is not securely suspended, being full of breakable and expensive toiletries, obvious safety problems arise.

One such device is shown in U.S. Pat. No. 2,954,898, patented Oct. 4, 1960 by L. R. Freeburg. The Freeburg kit structure consists of a base portion having specific sized recesses for holding specific sized articles. It further provides an elongated handle extending through a removable cover. This device has the disadvantage that with the cover removed, if the base was jarred somewhat, the contents might fall out of their recesses and spill or break. Furthermore, only certain items will fit into the specifically dimensioned recesses. The handle which extends up from the base is useful for transporting the device, but unless there is a hook of sorts available in the shower stall, which seems unlikely, the user will be unable to conveniently suspend the kit for easy access.

With the foregoing in mind, it would appear that there is a real need in the art to provide a rigid container for toiletries, or similar articles, which may receive a variety of differing sized items for easy and secure transport to the shower or elsewhere. Furthermore, it would be desirable to provide such a container with an unobtrusive hook for easy suspension whenever desired.

SUMMARY OF THE INVENTION

To this end the carrying kit of this invention is designed to transport a plurality of short or long articles of different size, shape and configuration, such as toiletries for shower use, shoe shining material, cleaning material, painting material or the like. The kit, therefore, comprises a generally cubical, one piece, non-collapsible container of rigid material, not intended to be disposable, but intended for repeated use in the shower or elsewhere around a home, hotel, dormitory or barracks. The container includes a rectangular bottom wall, elongated upstanding side walls, shorter upstanding end walls, a central elongated partition wall dividing it into two compartments of equal area in plan and a plurality of cross partition walls dividing each compartment into a plurality of open top cells of different areas in plan.

The configuration of the cells and compartments enable the user to transport toiletry articles to the shower as well as using the container as a first aid kit, shoe shine kit, desk kit, or tool kit. The present invention is a versatile container or kit, and may be hung or suspended in any convenient location.

This is achieved by including on the container a hook, pivotally mounted on one of the container side walls or on the central partition wall and normally pivoted downwardly when at rest. The hook may be pivoted upwardly for attachment to a shower pipe or any other convenient place.

A handle for carrying the container is integral with one of the partitions. Consequently, in use the container filled with the desired articles may be carried by the handle to a destination and suspended by the hook for easy access.

For convenience, the container of this present invention includes drainage holes in the bottom wall to prevent water build-up, should the kit be used in the shower. In addition, the kit may include rounded cup shaped pockets on the outside of the end walls of the container for holding jewelry, lipstick, toothbrushes, razors, and the like. A removable or fixed cover may be added to one of the compartments to further support items such as toothpaste and toothbrushes.

The container or kit of the present invention is of rigid material, easy to manufacture and convenient to use for a multitude of purposes. The configuration of the individual compartments permits use by any number of articles and prevents the articles from falling over. The handle, integral with one of the partitions, is stable and convenient to use as well as economical to manufacture. The pivotally mounted hook enables easy suspension wherever the container may be used, i.e. shower, work shop, or at a desk.

BRIEF DESCRIPTION OF THE DRAWINGS

These and other objects of the present invention and various features and details in accordance with the present invention are hereinafter more fully set forth with reference to the accompanying drawings wherein.

DESCRIPTION OF THE PREFERRED EMBODIMENT

Figure 1:
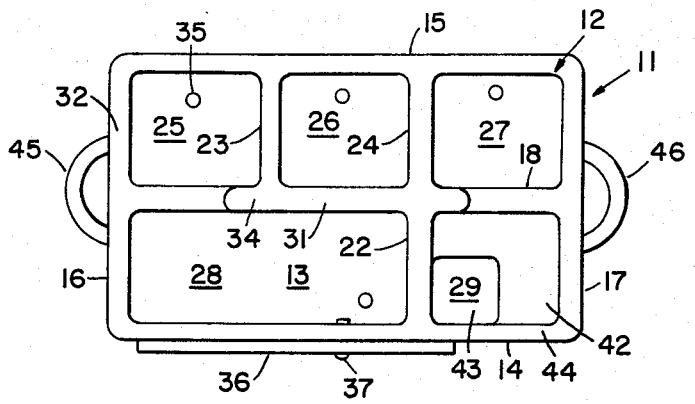
FIG. 1, is a top plan view of a carrying kit in accordance with the present invention.

As shown in the drawing, the carrying kit 11 of the invention includes the rigid, non-collapsible container 12 of generally cubical configuration having the bottom wall, or base 13, a pair of elongated side walls 14 and 15 upstanding from the bottom 13, and a pair of shorter end walls 16 and 17 also upstanding from the bottom 13.

A central elongated partition wall 18 extends between end walls 16 and 17 and upstands from the bottom 13, to divide the container 12 into two opposite compartments 19 and 21, each substantially equal in area in plan to the other.

A plurality of shorter cross partition walls such as 22, 23, and 24, each extend transversely across one of the compartments 19 or 21, normal to walls 14, 15, and 18, to divide the compartments into cells 25, 26, 27, 28, and 29. It should be noted that cell 28 is of larger area in plan than the area in plan of cells 25, 26, 27 and 29, so that it can be used for larger articles such as oval cross section bottles, or the like.

The central partition wall 18 includes an upper integral portion 31, extending above the level of the upper rim 32, of the side and end walls of the container 12, and above the level of the cross partition walls 22, 23, and 24, there being an elongated hand hole aperture 33 in upper portion 31, to form a carrying handle 34.

All of the walls 13, 14, 15, 16, 17, 18, 22, 23, and 24 of container 12, are formed of rigid, self-supporting material, integral and one piece, and preferably of plastic so that the kit 11, can be repeatedly used for any selected household purpose, can be easily cleaned and will drain through drain holes 35 if used as a shower article kit.

Figure 2:
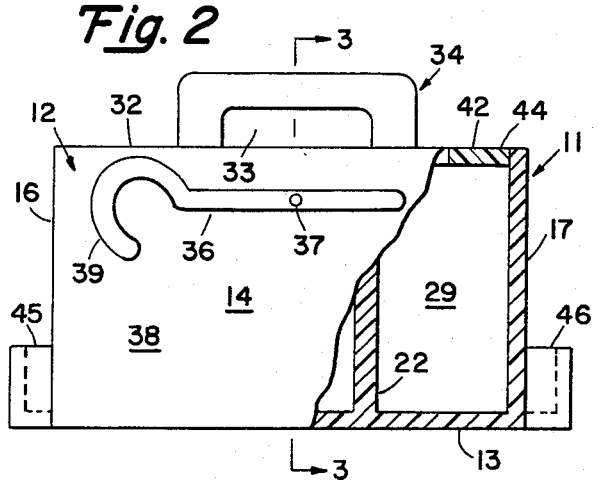
FIG. 2, is a side elevational view of the present invention having a portion thereof partly cut away.
Figure 3:
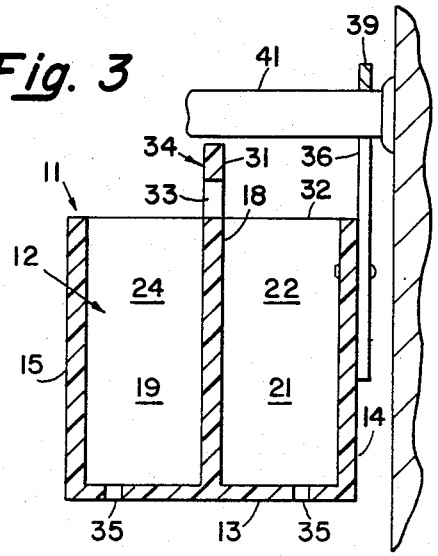
FIG. 3, is an end elevational view in section, along the line 3—3 of FIG. 2.
Figure 4:
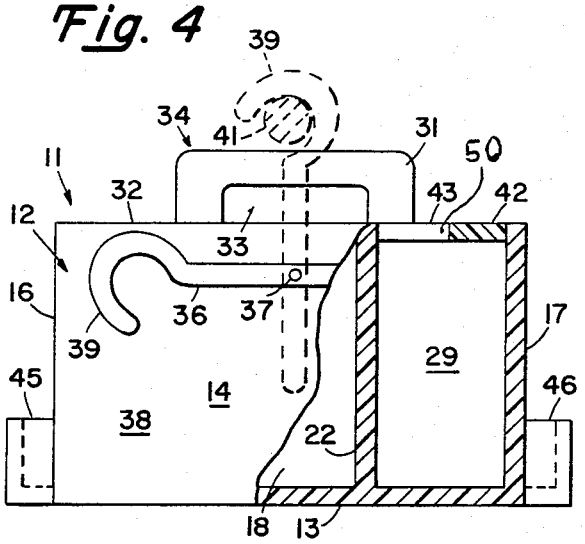
FIG. 4, is a side elevational view of the present invention showing the positions of the hook and showing a removable cover over one cell.

The kit 11 includes a hook 36, preferably of thin, flat sheet metal, such as aluminum, pivoted at 37 to the exterior face 38, of one of the elongated side walls 14 or 15, and being movable from the normal position out of use shown in FIGS. 1, 2 and 4 to the erected positions shown in FIG. 3 and FIG. 4. The hooked portion 39 can be placed over a shower curtain rod 41, a shower pipe head or elsewhere, where convenient, and where the central aperture 33 would not be practical for hanging the kit in place. At rest, and not in use, the entire hook is located below the level of rim 32, while when erected in use the hooked portion 39 is at a level well above the level of handle 34.

Kit 11 preferably includes a cover 42, having a central aperture 43, over one of the cells such as cell 29, which changes the area in plan from the area of the other cells in plan and helps to support unusually long articles such as toothbrushes, combs, etc. Cover 42 may be integral with container 12, but preferably is removable and seated within the tapered rim 44 around the open top 50, of the cell 29.

The kit 11 also preferably includes a plurality of integral relatively small, cup shaped receptacles 45 or 46, each projecting from one of the end walls 16 or 17 and integral therewith at a level proximate the level of bottom wall 13. These receptacles are for holding jewelry such as rings, lipsticks or other small items during a shower.

Figure 5:
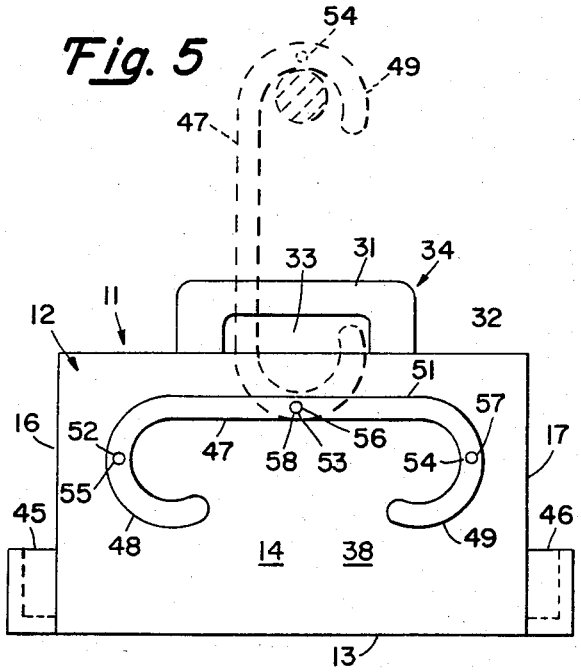
FIG. 5 is a side elevational view of another embodiment of the present invention.

As shown in FIG. 5, a container 12 may have a hook 47, similar to hook 36, but double ended as at 48 and 49 and having an elongated shank 51, as well as a plurality of holes 52, 53, and 54 spaced therealong which fit over spaced threaded studs 55, 56, or 57 on the exterior face 38 of a wall 14 or 15. A threaded cap 58 is provided which fits the threaded studs and holds the double hooked element 47 on any selected one of the studs to support the kit against an end wall, against a room wall, or with a side wall against a room wall.

I claim:

1. A carrying kit for a plurality of articles of varying size, shape, and dimensions said kit comprising:

a rigid, non-collapsible container of generally cubical configuration having a bottom wall, a pair of elongated side walls, and a pair of shorter end walls upstanding from said bottom wall.

a central, elongated partition wall, extending between said end walls and upstanding from said bottom wall to divide said container into two opposite compartments of equal area in plan;

a plurality of shorter cross partition walls, each extending transversely across one of said compartments to divide said compartments into cells, some of different area in plan;

said central partition wall having an upper integral portion extending above the level of said side walls, end walls, and cross partition walls and being apertured to form a carrying handle;

all of said walls and said bottom being integral to form a one piece, rigid carrying kit;

and an elongated hook, pivotally mounted on one of said walls and movable from a down position below the level of the top of said side and end walls to an up position, with the hook extending above the level of said upper portion of said central partition wall for suspending said kit on a shower head pipe or shower curtain rod.

2. A carrying kit as specified in claim 1 wherein:

said container includes a cover removably affixed over one of said cells, said cover having an opening centrally thereof for receiving a toothbrush, toothpaste, comb, or other elongated article.

3. A carrying kit as specified in claim 1 wherein:

said hook is pivotally mounted on the exterior of one of the elongated side walls of said container.

4. A carrying kit as specified in claim 1 wherein:

said container includes a plurality of integral, relatively small, cup shaped receptacles each projecting from one of said end walls proximate the level of said bottom for receiving rings or other jewelry of the user.

5. A carrying kit as specified in claim 1 wherein:

a plurality of threaded studs are spaced apart on one of said side walls to project laterally therefrom, said hook has an elongated shank with a hook at each opposite end, said shank has a plurality of apertures spaced therealong to fit over one of said studs and said kit includes a threaded cap for retaining said hook on any one of said studs.

* * * * *